US007717427B2

(12) United States Patent
Grauzer et al.

(10) Patent No.: US 7,717,427 B2
(45) Date of Patent: May 18, 2010

(54) PLAYING CARD DEALING SHOE WITH AUTOMATED INTERNAL CARD FEEDING AND CARD READING

(75) Inventors: Atilla Grauzer, Las Vegas, NV (US); Oliver M. Schubert, Las Vegas, NV (US); James V. Kelly, Las Vegas, NV (US); James B. Stasson, Eden Prairie, MN (US); Paul K. Scheper, Eden Prairie, MN (US)

(73) Assignee: Shuffle Master, Inc., Las Vegas, NV (US)

( * ) Notice: Subject to any disclaimer, the term of this patent is extended or adjusted under 35 U.S.C. 154(b) by 394 days.

(21) Appl. No.: 11/200,280

(22) Filed: Aug. 9, 2005

(65) Prior Publication Data

US 2006/0033269 A1 Feb. 16, 2006

Related U.S. Application Data

(62) Division of application No. 10/622,321, filed on Jul. 17, 2003, now Pat. No. 7,029,009.

(51) Int. Cl.
*A63F 1/14* (2006.01)

(52) U.S. Cl. ..... 273/149 R; 463/22; 273/149 P

(58) Field of Classification Search ..... 273/149 R, 273/149 P; 463/22, 16
See application file for complete search history.

(56) References Cited

U.S. PATENT DOCUMENTS 3,222,071 A 12/1965 Lang
3,929,339 A 12/1975 Mattioli
4,534,562 A 8/1985 Cuff et al.
4,667,959 A 5/1987 Pfeiffer et al.
4,750,743 A 6/1988 Nicoletti
5,356,145 A 10/1994 Verschoor (Continued)

FOREIGN PATENT DOCUMENTS

WO WO 98/40136 9/1998
WO WO 00/51076 8/2000

OTHER PUBLICATIONS

Supplementary European Search Report for Application No. EP 04 77 8258, Nov. 12. 2007.
International Search Report and Written Opinion of the International Searching Authority for International Application No. PCT/USO4122654, Jan. 12, 2005.

*Primary Examiner*—Benjamin H Layno
(74) *Attorney, Agent, or Firm*—Mark A. Litman & Associates, P.A.

(57) ABSTRACT

A distinct dealing shoe having no shuffling functionality receives shuffled, randomized or ordered group of cards. The cards may be mechanically moved one at a time from a receiving area for the deck to a buffer area where more than one card is temporarily stored. The cards in the buffer area are then mechanically moved to a card delivery area where the cards may be manually removed, one-at-a-time, by a dealer. The cards are read one-at-a-time inside of the dealing shoe, either before the buffer area or after leaving the buffer area, but preferably before the cards are being manually removed from the card delivery area. The information from the card reading may be used for game tracking, hand tracking, player information, and other security issues at casino table card games.

8 Claims, 3 Drawing Sheets

U.S. PATENT DOCUMENTS 5,374,061 A 12/1994 Albrecht
5,605,334 A 2/1997 McCrea, Jr.
5,669,816 A 9/1997 Garczynski et al.
5,681,039 A 10/1997 Miller
5,683,085 A * 11/1997 Johnson et al. ..... 273/149 R
5,722,893 A 3/1998 Hill et al.
5,772,505 A 6/1998 Garczynski et al.
5,779,546 A 7/1998 Meissner et al.
5,941,769 A 8/1999 Order
5,989,122 A 11/1999 Roblejo
6,039,650 A 3/2000 Hill
6,093,103 A 7/2000 McCrea, Jr.
6,117,012 A 9/2000 McCrea, Jr.
6,126,166 A 10/2000 Lorson et al.
6,165,069 A 12/2000 Sines et al.
6,217,447 B1 4/2001 Lofink et al.
6,250,632 B1 6/2001 Albrecht
6,267,648 B1 7/2001 Johnson et al.
6,270,404 B2 8/2001 Sines et al.
6,299,536 B1 10/2001 Hill
6,346,044 B1 2/2002 McCrea
6,361,044 B1 3/2002 Block et al.
6,403,908 B2 6/2002 Stardust et al.
6,460,848 B1 10/2002 Soltys et al.
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,530,836 B2 3/2003 Soltys et al.
6,530,837 B2 3/2003 Soltys et al.
6,533,276 B2 3/2003 Soltys et al.
6,533,662 B2 3/2003 Soltys et al.
6,579,180 B2 6/2003 Soltys et al.
6,579,181 B2 6/2003 Soltys et al.
6,638,161 B2 10/2003 Soltys et al.

* cited by examiner

PLAYING CARD DEALING SHOE WITH AUTOMATED INTERNAL CARD FEEDING AND CARD READING

RELATED APPLICATIONS DATA

This Application is a divisional application claiming priority from U.S. patent application Ser. No. 10/622,321, filed 17 Jul. 2003, now U.S. Pat. No. 7,029,009.

BACKGROUND OF THE INVENTION

1. Field of the Invention

The present invention relates to playing card handling apparatus and particularly to playing card dealing shoes that read and report playing card rank before the cards are dealt to players at a casino table card game.

2. Background of the Art

Casinos and other forms of gaming are major international businesses having billion-dollar impact upon local economies. Wagering is effected at table games by customers (e.g., players) purchasing a casino's chips. The customer uses the chips as wagers on various games, such as blackjack, table poker, craps, roulette, baccarat and other table wagering games. The casino pays out winnings with additional chips based on the rules of the particular game. The casino collects the customers' chips for losing wagers.

Like many businesses, there are numerous clerical and statistical matters that are of concern to the operation of the business. In casinos, a critical issue is game security. This is important in every industry, but is particularly critical in the gaming industry because of the continuing exchange and flow of money (e.g., in the form of chips). Casinos have to monitor the actions of both the customers and the casino employees carefully to be certain that mistakes, cheating or theft does not occur in the casino. To be able to monitor security in the casinos, many different types of systems interact to provide a full spectrum base of information on events occurring in the casino. Among the systems used are security monitors (that watch and record every square foot of a casino floor and overlaps many areas with different angle shots), floorwalkers, pit crews, camera surveillance teams, gaming table security measures (e.g., anti-tampering security on slot-type machines, data security on processor-based gaming apparatus, central control of slot-type gaming apparatus), and the like. Newer electronic systems that have been discussed for years, but are only now being implemented include card reading shufflers, card reading trays, chip reading racks, scanning systems for reading chips in wagering positions, and the like.

Among the more assertive systems for blackjack (and other table game) security systems that have been disclosed and marketed is the MindPlay LLP casino table security system represented by U.S. Pat. Nos. 6,533,662; 6,533,276; 6,530,837; 6,530,836; 6,527,271; 6,520,857; 6,517,436; 6,517,435; and 6,460,848.

U.S. Pat. No. 6,460,848 (Soltys) particularly deals with playing card reading systems and describes a system that automatically monitors playing and wagering of a game, including the gaming habits of players and the performance of employees. A card deck reader automatically reads a symbol from each card in a deck of cards before a first one of the cards is removed from the card reader. The symbol identifies a respective rank and suit of the card. In actual use, the complete set (e.g., deck or decks) of cards is removed from the card-reading tray and dealt by hand. A chip tray reader automatically images the contents of a chip tray, to periodically determine the number and value of chips in the chip tray, and to compare the change in contents of the chip tray to the outcome of game play for verifying that the proper amounts have been paid out and collected. A table monitor automatically images the activity occurring at a gaming table. Periodic comparisons of the images identify wagering, as well as the appearance, removal and position of cards and other game objects on the gaming table. A drop box automatically verifies an amount and authenticity of a deposit and reconciles the deposit with a change in the contents of the chip tray. The drop box employs a variety of lighting and resolutions to image selected portions of the deposited item. The system detects prohibited playing and wagering patterns, and determines the win/loss percentage of the players and the dealer, as well as a number of other statistically relevant measures. The measurements provide automated security and real-time accounting. The measurements also provide a basis for automatically allocating complimentary player benefits.

The operation of the Soltys card-reading system is described as feeding of the cards into the storage area of the rack, exposing them to reading sensors that read an edge of the cards. That system reads cards after they are put into a cradle (which is a housing sized for receiving playing cards), and therefore reads all of the cards (a plurality of cards) before a first card is removed from the cradle.

U.S. Pat. No. 4,667,959 (Pfeiffer) describes a card handling apparatus having a card hopper adapted to hold from one to at least 104 cards, a card carousel having slots for holding cards, an injector for sequentially loading cards from the hopper into the carousel, output ports, ejectors for delivering cards from the carousel to any one of the output ports, and a control board and sensors, all housed in a housing. The apparatus is also capable of communicating with selectors, which are adjustable for making card selections. The injector has three rollers driven by a motor via a worm gear. A spring-loaded lever keeps cards in the hopper pressed against the first roller. The ejectors are pivotally mounted to the base of the housing beneath the carousel and comprise a roller driven by a motor via gears and a centripetal clutch. A control board keeps track of the identity of cards in each slot, card selections, and the carousel position. Cards may be ordinary playing cards or other cards with bar codes added for card identification by the apparatus. A unique carousel design reads cards as they are placed into compartments and an ejector pushes specific cards out of compartments to provide specific card sets.

U.S. Pat. No. 4,750,743 (NICOLETTI) describes a dispenser for playing cards comprising: a shoe adapted to contain a plurality of stacked playing cards, the playing cards including a leading card and a trailing card; the second side walls, a front wall, a base, and an inclined floor extending from the back wall to proximate the front wall and adapted to support the playing cards; the floor being inclined downwardly from the back wall to the front wall; the front wall having an opening and otherwise being adapted to conceal the leading card; and the front wall, side walls, base and floor enclosing a slot positioned adjacent the floor, the slot being sized to permit a playing card to pass through the slot; card advancing means contacting the trailing card and adapted to urge the stacked cards down the inclined floor; card dispensing means positioned proximate the front wall and adapted to dispense a single card at a time, the card dispensing means including leading card contact means adapted for rotation about an axis parallel to the leading card, whereby rotation of the leading card contact means displaces the leading card relative to the card stack and into a predetermined position extending out of the shoe from the slot; and an endless belt located in the opening in the front wall for rotating the leading card contact means, the endless belt having an exterior surface securely engaging the leading card contact means and being adapted to be displaced by an operator. The Nicoletti device requires the use of a mechanical means to advance cards out of the shoe.

U.S. Pat. No. 5,681,039 (MILLER) describes a device for determining whether a dealer has a blackjack (a first two-card count of twenty-one) with a device for speeding the pace of a game of blackjack. The device is comprised of a housing having a top surface. A card reader for reading at least a portion of a playing card is located within the housing. An indicator cooperating with the card reader is provided to inform the dealer if his down card is of a desired value. Only a single card is read at the dealer's position. This device is little more than a table mounted system enabling reading of single cards to determine if a blackjack occurs to a dealer during a game of Twenty-One. This patent is not infringed by the Shuffle Master system. The device has no motor. It indicates the presence of an ace or ten as the hole card in the dealers Blackjack hand.

U.S. Pat. No. 5,779,546 (MEISSNER) describes a method and apparatus enabling a game to be played based upon a plurality of cards. An automated dealing shoe dispenses each of the cards and recognizes each of the cards as each of the cards is dispensed. Player stations are also included. Each player station enables a player to enter a bet, request that a card be dispensed or not dispensed, and to convert each bet into a win or a loss based upon the cards that are dispensed by the automated dealing shoe. This patent requires a system organization (betting and card calling functions at each player position and win-tracking as a result of play). The dealer shoe reads the cards one-at-a-time when driven by a single drive wheel into the card read station. The cards are fed from a sloped tray and are moved at constant speed to enable accurate reading of the cards.

U.S. Pat. No. 5,989,122 (ROBLEJO) relates to an apparatus for randomizing and verifying sets of playing cards. Also, the invention relates to a process providing such an apparatus; feeding to the apparatus one or more cards either after they have been played in a game or from an un-randomized or unverified set of cards; and manually retrieving a verified true set of cards from the apparatus. Also, the invention relates to a process of playing in a casino setting or simulated casino setting, a card game comprising providing such an apparatus, feeding unverified sets of playing cards to the apparatus, and recovering verified true sets of cards from the apparatus.

The invention is directed towards a complete apparatus with stacking compartments that sorts and/or randomizes cards. This function is not provided in the Smart Dealer Shoe that merely receives cards separately from a shuffler and then reads the cards. The cards are read in the apparatus of the Patent, but this apparatus is required to be a shuffling or sorting apparatus.

U.S. Pat. Nos. 5,605,334; 6,093,103 and 6,117,012 (McCrea) describe a secure game table system, adapted for multiple sites under a central control, for monitoring each hand in a live card game. A common deck identity code is located on each card. A shuffler has a circuit for counting the cards from a previous hand which are inserted into the shuffler and which reads the common identity code. The game control verifies that no cards have been withdrawn from the hand by a player or that new cards have been substituted. A unique code also placed on each card is read as the card is dealt to indicate the value and the suit. The game control stores this information in a memory so that a history of each card dealt is recorded. Sensors are located near each of the player positions for sensing the presence of a game bet and a progressive bet. A card sensor located near each player position and the dealer position issues a signal for each card received. The game control receives these signals and correlates those player positions having placed a game and/or progressive bet with the received cards. The game control at each table has stored in memory the winning combinations necessary to win the progressive jackpots. Since the game control accurately stores the suit and value of each card received at a particular player position, the game control can automatically detect a winning progressive combination and issue an award signal for that player position. The shoe element has the card reading components in the card withdrawal area. When integrated into a shuffling device, the camera may capture images at various positions before and at the delivery area.

U.S. Pat. No. 6,250,632 (ALBRECHT) describes an apparatus and method for sorting cards into a predetermined sequence. One embodiment provides a deck holding area in which cards are held for presenting a card to a read head for reading the characters on the face of the card. The apparatus also has a tray having a sequence of slots and a card moving mechanism for moving the presented card from the deck holding area into one of the slots. The tray is connected to a tray positioning mechanism for selectively positioning the tray to receive a card in one of the slots from the card moving mechanism. A controller is connected to the read bead, the card moving mechanism, and the tray positioning mechanism. The controller controls the reading of each of the cards by the read head and identifies the value of each card read, and also controls the card moving mechanism to move each of the cards to a slot of the tray positioned by the tray positioning mechanism according to the predetermined sequence of values. The method for sorting includes the step of providing a tray having a sequence of slots, determining a predetermined sequence of values for the cards, and reading the face of a card to determine the value the card. The method further includes moving the read card into one of the slots of the tray. The position of the slot into which the read card is moved corresponds to the position of the value in the predetermined sequence. This Patent requires the combination of a sorting/shuffling function in the apparatus.

U.S. Pat. No. 6,267,648 (JOHNSON) describes a collation and/or sorting apparatus for groups of articles is exemplified by a sorting and/or shuffling device for playing cards. The apparatus comprises a sensor (15) to identify articles for collation and/or sorting, feeding means to feed cards from a stack (11) past the sensor (15) to a delivery means (14) adapted to deliver cards individually to a preselected one of a storing means (24) in an indexable magazine (20). A microprocessor (16) coupled to the feed means (14), delivery means (18), sensor (15) and magazine (20) determines according to a preprogrammed routine whether cards identified by sensor (15) are collated in the magazine (20) as an ordered deck of cards or a randomly ordered or "shuffled" deck. The cards are read in the apparatus, but this is a shuffling or sorting apparatus.

U.S. Pat. No. 6,361,044 (BLOCK) describes a top of a card table with a card-dispensing hole there through and an arcuate edge is covered by a transparent dome shaped cover. A dealer position is centrally located on the tabletop. A plurality of player stations are evenly spaced along the arcuate edge. A rotatable card placement assembly includes an extendable arm that is connected to a card carrier that is operable to carry a card. In response to signals from the computer, the rotation of the assembly and the extension of the arm cause the card carrier to carry the card from the card-dispensing hole to either the dealer position or any of the player positions. The card carries a bar code identification thereon. A bar code reader of the card carrier provides a signal representation of the identification of the card to the computer. This Patent requires numerous structural features, not the least of which is the bubble. This Block system is a robotic system reading the cards as they are dispensed from a rotating card carrier.

U.S. Pat. No. 6,403,908 (Stardust) describes an automated method and apparatus for sequencing and/or inspecting decks of playing cards. The method and apparatus utilizes pattern recognition technology or other image comparison technology to compare one or more images of a card with memory containing known good images of a complete deck of playing cards to identify each card as it passes through the apparatus. Once the card is identified, it is temporarily stored in a location corresponding to or identified according to its position in a properly sequenced deck of playing cards. Once a full set of cards has been stored, the cards are released in proper sequence to a completed deck hopper. The method and apparatus also includes an operator interface capable of displaying a magnified version of potential defects or problem areas contained on a card which may then be viewed by the operator on a monitor or screen and either accepted or rejected via operator input. The device is also capable of providing an overall wear rating for each deck of playing cards. Stardust requires identification of cards and storage of individual cards with the identity of the card recognized in a storage position that becomes unique for a card value so that an ordered deck may be constructed in a final collection area. The cards are read and then stored in identified and recoverable positions. The identified cards are then directed, in ranked and suited order, into a final collection area where the ordered deck is formed. The intermediate storage device requires that individual ranked and suited cards are positioned in a temporary storage device between the input area and the removal area to increase the overall speed of card feeding with rank and suit reading and/or scanning to the dealer.

U.S. Pat. No. 6,217,447 (LOFINK) describes a method and system for generating displays related to the play of Baccarat is provided. Cards dealt to each of the Banker's and Player's hands are identified as by scanning and data signals are generated. The card identification data signals are processed to determine the outcome of the hand. Displays in various formats to be used by bettors are created from the processed identification signals including the cards of the hand played, historical records of outcomes and the like. The display can also show bettors expected outcomes and historical bests. Bettors can refer to the display in making betting decisions. The cards are read between the shoe and the player positions. The card reading of Lofink is done on removal of the card from the shoe and displayed on a video screen.

U.S. Pat. No. 5,669,819 (GARCZYNSKI) describes a module for announcing when a Dealer has blackjack without exposing the face of the Dealer's down card. The module scans a character from the Dealer's facedown standard playing card, compares the result of the scan with a set of references, and identifies the down card. The module also receives input from the Dealer as to the identity of the Dealer's up card, and announces whether the Dealer has blackjack or the hand continues. The module is designed to be mounted to a blackjack table such that the surface of the module on which the standard playing card rests while being scanned is in the plane of the surface of the blackjack table, allowing the Dealer to slide the down-card across the table and onto the scanner without lifting, and potentially exposing, the card's face. The module also removes the noise generated by a casino's heat, dust, cigarette and cigar ashes, and lint from the felt of the blackjack table, during the scanning process. The module further optimizes the scan of the character on the standard playing card by controlling the light intensity emitted by the components of the module used to illuminate the character.

U.S. Pat. No. 5,772,505 (GARCZYNSKI) describes a dual card-scanning module that announces when the symbols of a face-up standard playing card and a facedown standard playing card achieve a desired combination. The module has a scanner system that illuminates and scans at least a portion of a symbol of the face-up standard playing card and at least a portion of a symbol of the face-down standard playing card and stores the results thereof in a first and second array device, respectively. The module also has a guide to assist in receiving and positioning the cards such that the face-up standard playing card is above and aligned with the facedown-standard playing card. When in this position, the symbol portions of the face-up and the facedown-standard playing cards can be scanned by the array devices to generate respective scanning results. The module compares the scanning results with a memory storing a plurality of references representing respective symbols of the standard playing cards to determine if the cards have achieved the desired combination. The card is not read in the dealer's shoe, but at the dealer's hand position.

U.S. Pat. Nos. 6,039,650; and 5,722,893 (HILL) is directed to a shoe of the type described wherein the shoe has a card scanner which scans indicia on a playing card as the card moves along and out of a chute by manual direction by the dealer in the normal fashion. The scanner can be one of several different types of devices that will sense each card as it is moved downwardly and out of the shoe. A feed forward neural-network that is trained, using error back-propagation to recognize all possible card suits and card values sensed by the scanner. Such a neural-network becomes a part of a scanning system which provides a proper reading of the cards to determine the progress of the play of the game including how the game might suffer if the game players are allowed to count cards using a card count system and perform other acts which would limit the profit margin of the casino. The shoe is also provided with additional devices that make it simple and easy to record data relevant to the play of the game. For instance, the shoe has means for accommodating a "customer-tracking-card" or preferred customer card which reads the personal information of a cardholder from a magnetic strip on the card and this information travels with the preferred customer from game to game, throughout a casino, which the customer likes to play. An LCD display can also be part of the shoe and this display can be used to enter and retrieve vital player information as deemed necessary or desirable to the customer file opened when the magnetic stripe reader reads the preferred customer card with the customer name and account number embedded within the cards magnetic stripe. Scanned information is fed to a computer for extensive analysis.

U.S. Pat. No. 6,126,166 (LORSON) describes a system for monitoring play of a card game between a dealer and one or more players at a playing table, comprising:

(a) a card-dispensing shoe comprising one or more active card-recognition sensors positioned to generate signals corresponding to transitions between substantially light background and dark pip areas as standard playing cards are dispensed from the card-dispensing shoe, without generating a bit-mapped image of each dispensed standard playing card; and (b) a signal processing subsystem adapted to:

receive the transition signals generated by the active card-recognition sensors;

determine, in real time and based on the transition signals, playing-card values for the dispensed standard playing cards; and determine, in real time, a current table statistical advantage/disadvantage relative to the players for playing cards remaining in the card-dispensing shoe.

The system infers information on the distribution of cards in the discard shoe from knowledge of the sequence of cards dealt during game play. When signaled, the system determines appropriate sequence, number, and positions of the pre-shuffle plug locations of the cards in the discard shoe. The system transmits the pre-shuffle card plug information to an output device driver assembly that actuates the desired output devices. In one implementation, the system output devices are light-emitting diodes, but any number of electric, acoustic, or mechanical devices could be utilized. The dealer plugs the card segments as directed by the system output devices and signals completion by operating the control switch discussed above. The process is repeated until the card segments are properly positioned and then the system transmits an output signal to direct the dealer to shuffle the cards. This pre-shuffle mixing technique significantly reduces the post-shuffle statistical deck variations and improves current pre-shuffle mixing practices which are performed arbitrarily by the dealer and do not ensure adequate and consistent distribution of the card values following the shuffle. During play, the system monitors the cards received by the dealer and actuates an output device any time the dealer's first two cards consist of an ace and any ten-valued card. When the first card received by the dealer is an ace, the passive table mounted sensor delays actuation of the output device until all players have had the opportunity to place an optional blackjack game wager commonly referred to as insurance.

U.S. Pat. No. 5,941,769 (ORDER) describes an automatically working apparatus that will register and evaluate all phases of the run of the game automatically. This is achieved by a card shoe with an integrated device for recognition of the value of the drawn cards (3') (optical recognition device and mirroring into a CCD-image converter); photodiodes (52) arranged under the table cloth (51) in order to register separately the casino light passing through each area (53, 54) for placing the gaming chips (41) and areas (55, 56) for placing the playing cards (3) in dependence of the arrangement or movement of the jettons and playing cards on the mentioned areas; a device for automatic recognition of each bet (scanner to register the color of the jettons, or a RFID-system comprising a S/R station and jettons with integrated transponder); an EDP program created in accordance with the gaming rules to evaluate and store all data transmitted from the functional devices to the computer; and a monitor to display the run of the game and players' wins.

U.S. Pat. No. 6,299,536 (HILL) describes a player tracking system that requires at least: A card delivery and player proficiency evaluation system for playing a card game comprising: a) a housing configured to store a plurality of playing cards and configured for dispensing cards to a number of players; b) a scanner configured to scan each of the cards dispensed from the housing and to generate a scanner signal representative of the identity of each card dispensed to each of the players; and c) a processor coupled to the scanner and configured to process the scanner signal to identify each of the cards dispensed to each of the players playing the card game and to determine at least one statistic in the play of the game relative to predetermined criteria to thereby evaluate the proficiency of each of the players.

WO 00/51076 (DOLPHIN ADVANCED TECHNOLOGIES PTY. LTD.) describes a card inspection device for playing cards. The device has a loading area for two or more decks of cards, a feed roller and a loading area through which cards are urged one at a time by the feed roller. A digital camera is used to image cards in the loading area through a window.

SUMMARY OF THE INVENTION

A distinct dealing shoe having no shuffling functionality receives shuffled, randomized or ordered groups of cards. The cards are mechanically moved one at a time from a receiving area for the groups of cards (e.g., deck or decks of cards) to a buffer area where more than one card is temporarily stored. The cards in the buffer area are then mechanically moved to a card delivery area where the cards may be manually removed, one-at-a-time, by a dealer. The cards are read one-at-a-time inside of the dealing shoe, either before the buffer area or after leaving the buffer area, but before the cards are being manually removed from the card delivery area. The information from the card reading may be used for game tracking, hand tracking, player information, and other security issues at casino table card games.

DETAILED DESCRIPTION OF THE INVENTION

Cards are provided to players in casino table card games either directly from a deck held in the dealer's hands or with cards removed by the dealer from a dealing shoe or dealing rack. The original racks were little more than trays that supported the deck(s) of cards in a tray and allowed the dealer to remove the front card (with its back facing the table to hide the rank of the card) and deliver it to a player.

The present dealing shoe provides additional functions without greatly increasing the space on the casino tabletop used by the dealing shoe. The shoe provides cards securely to a delivery area and reads the cards before they are actually nested in the card delivery area. The card reading information is either stored or transferred to a central computer for storage and/or evaluation. The cards are mechanically transferred from a point of entry into the dealing shoe to the card delivery area, with a buffer area in the path where at least some cards are actually held for a period of time. The cards are preferably read before they are delivered into the card delivery area.

Figure 1:
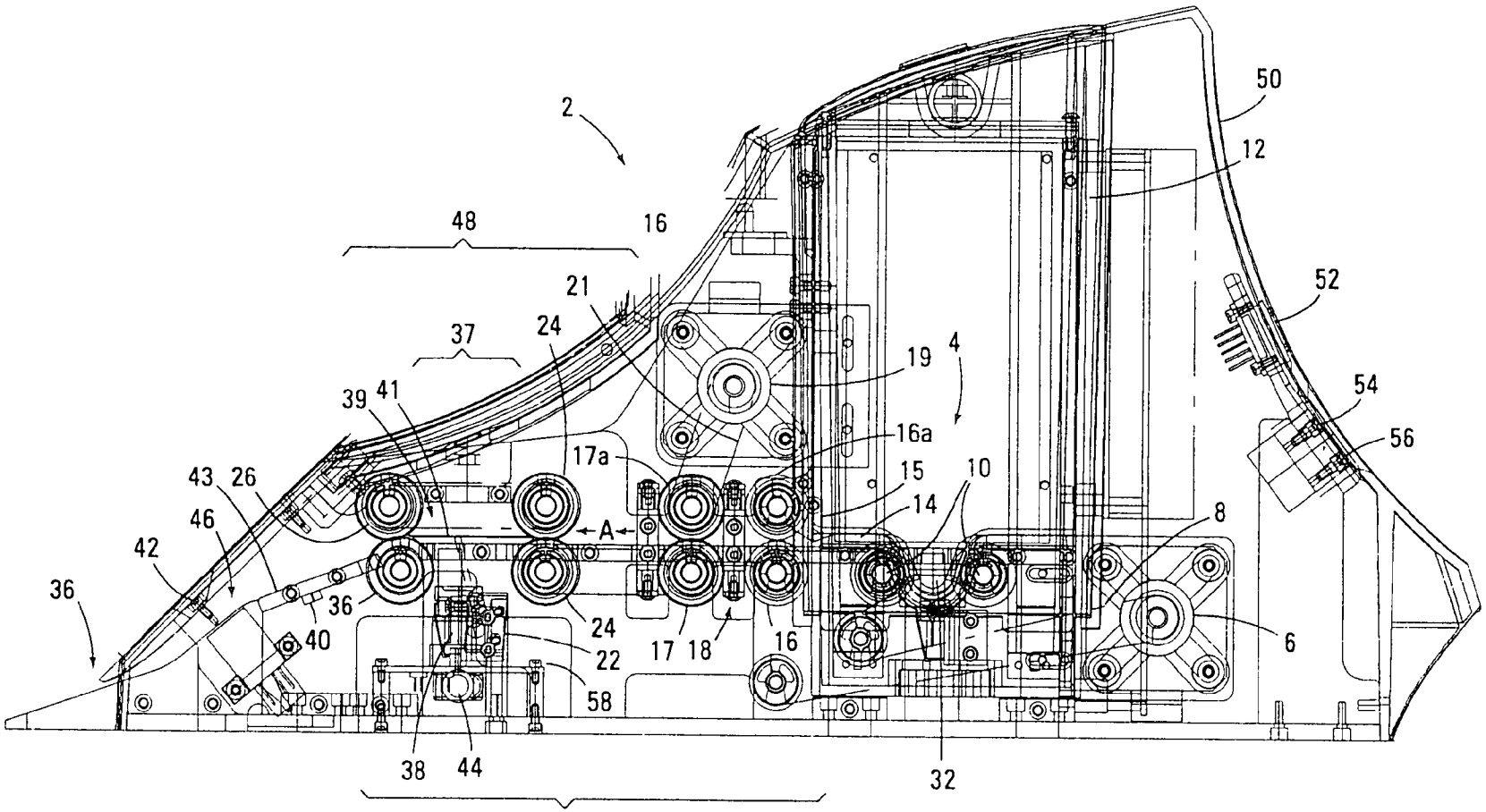
FIG. 1 shows a cutaway view of the side of a dealing shoe according to the invention.

Reference to the Figures will help in an appreciation of the nature and structure of the card delivery shoe of the invention. FIG. 1 shows a card delivery shoe 2 according to the present invention. The card delivery shoe 2 has a card in-feed or card input area 4 which is between a belt driving motor 6 and the rear panel 12 of the card delivery shoe 2. The belt driving motor 6 drives a belt 8 that engages pick off rollers 10. These pick off rollers 10 pick off and move individual cards from within the card in-feed area 4. A belt driving motor 6 is shown but other motor types such as gear drives, axel drives, magnetic drives and the like may be alternatively used. The pick off rollers 10 drive individual playing cards (not shown) into gap 14 having a deflector plate 15 to direct cards individually through the gap 14 to engage brake rollers 16. The brake rollers 16 control the movement of individual cards past the rear panel 12 and into the card staging area 34. The braking rollers 16 are capable of becoming free-turning rollers during a card jam recovery process so that little or no tension is placed on a card as it is being moved by the system or manually to free a jam. A simple gear release or clutch release can effect this function. Speed up rollers 17 apply tension to a card to move it more deeply into the card staging area 34. The speed up rollers can and may turn faster then the braking rollers 16, and the speed up rollers 17 may be driven by a separate motor 19 and belt drive 21. A card path and direction of movement A is shown through the card storage area 34. As individual cards are passed along the card path A through the card storage area 34, there are card presence sensors 18, 20, and 22 located at various intervals and positions to detect the presence of cards to assure passage of cards and/or to detect stalled or jammed cards. The path A through the card storage area 34 is in part defined by speed-up rollers 17 or rear guide rollers 24 and forward guide rollers 26 which follow the brake rollers 16 and the speed up rollers 17. One form of a buffer area 48 is established by the storing of cards along card path A. As cards are withdrawn from the delivery end 36 of the delivery shoe 2, additional cards are fed from the buffer area 48 into the card feed chute 46 into the delivery end 36.

It is always possible for cards to jam, misalign or stick during internal movement of cards through the dealing shoe. There are a number of mechanisms that can be used to effect jam recovery. The jam recovery may be based upon an identified (sensed) position of jam or may be an automated sequence of events. Where a card jam recovery is specifically identified by the sensed position of a jammed card in the device (and even the number of cards jammed may be estimated by the dimensions of the sensed image), a jam recovery procedure may be initiated at that specific location. A specific location in FIG. 1 within the dealing shoe (e.g., between and inclusive of rollers 16 and 17 will be discussed from an exemplary perspective, but the discussion relates to all other positions within the device.

If a card is sensed (e.g., by sensors 18 and/or 20) as jammed between rollers 16 and 17 (e.g., a jam occurs when cards will not move out of the position between the rollers and cards refuse to be fed into that area), one of a various number of procedures may be initiated to recover or remove the jam. Among the various procedures that are discussed by way of non-limiting examples include at least the following. The rear-most set of rollers (16 and 16*a*) may reverse direction (e.g., 16 begins to turn clockwise and 16*a* begins to turn counterclockwise) to remove the jammed card from between the rollers (16 and 16*a*) and have the card extend backwards into the space 14, without attempting to reinsert a card into the stacking area 4. The reversed rotation may be limited to assure that the card remains in contact with the rollers 16 and 16*a*, so that the card can be moved back into progression through the dealing shoe. An optional part of this reversal can include allowing rollers 17 and 17*a* to become free rolling to release contact and tension on the card during the reversal. The reversed rotation may be smoothly run or episodic, attempting to jerk a jammed card from its jam position. If that procedure does not work or as an alternative procedure, both sets of rollers 16 and 17 may reverse at the same time or in either sequence (e.g., 16 first or 17 first) to attempt to free the jam of a card. When one set of rollers only is turning, it is likely to be desirable to have the other set of rollers in the area of the jam to become free rolling. It is also possible to have the rollers automatically spaced further apart (e.g., by separating roller pairs to increase the gap in the potential nip between rollers) to relieve tension on a card and to facilitate its recovery from a jam. The adjacent pairs of rollers (e.g., 16, 16*a* and 17, 17*a*) can act in coordination, in sequence, in tandem, in order, independently or in any predefined manner. For example, referring to the roller sets as 16 and 17, the recovery process may have the rollers act as a) (16-17) at the same time in the same direction), b) (16-17) at the same time in the opposite directions to assist in straightening out cards, c) (16 then 17) to have the rollers work sequentially, d) (17 then 16) to have the rollers work in a different sequence, e) 16 only for an extended time, and then 17 operating alone or together with 16, f) 17 only for an extended time or extended number of individual attempts and then 16 for a prescribed time, etc. As noted earlier, a non-active roller (one that is not attempting to drive or align cards) may become free rolling during operation of another roller.

These various programs may be performed at a single jam location in series or only a single program for jam recovery may be effected. In addition, as the card may have been read at the point of the jam or before the jam, the rank and value of the card jammed may be identified and this can be displayed on the display panel on the dealing shoe, on the central computer or on a shuffler connected to the dealing shoe, and the dealer or pit boss may examine that specific card to make certain that no markings or damage has occurred on that card which could either cause further problems with the dealing shoe or shuffler or could enable the card to be identified when it is in the dealing position in the shoe at a later time. The pit crew can then correct any problem by replacement of that specific card, which would minimize down time at the card table. Also, if a jam cannot be recovered, the delivery shoe would indicate a jam recovery failure (e.g., by a special light or alphanumeric display) and the pit crew would open the device and remove the jam manually.

Individual playing cards (not shown) may be read at one or more various locations within the card delivery shoe 2. The ability to provide multiple read locations assures performance of the shoe, while other card delivery trays with read capability usually had a single reading position at the point where and when cards were removed from the shoe for delivery to players. For example, in the construction shown in FIG. 1, the card presence sensors 18, 20 and 22 may also have card reading capabilities, and other card reading sensors may be present as elements 32, 40 and 42. Element 38 may be optionally present as another sensing element or a card value (and possibly suit) reading element without the presence of sensor 22 or in combination with sensor 22. When the sensor 38 functions as a card reading element, it should read the cards as they are positioned into the car pre-delivery area or card buffer area 37, rather then as the cards are removed from the card delivery end 36. Information may be read by the card-reading sensor 38 by either continuous reading of all image data in the card pre-delivery area or by triggered on-off imaging of data in a specific region of cards 39 as a card 41 is within the pre-delivery area 37. For example, card presence sensor 22 may activate sensor 38. This sensor is preferably a camera. A light source (not shown) may be provided to enhance the signal to the sensor 38. That specific region of cards is preferably a corner of the card 41 wherein complete value information (and possibly suit information) is readable on the card, such as a corner with value and suit ranging symbols on the card. That region could also be the entire face of the card, or at lease ½ of the card (lengthwise divided). By increasing the area of the region read more processing and memory is required, but accuracy is also increased. Accuracy could also be increased, by reading the upper right hand corner of the card and lower left hand corner, since both of those locations contain the rank and suit of the card. By reading 2 locations on the card, defects or dirt on the card can be circumvented. By using on-off or single shot imaging of each card 41, the data flow from the sensor/card reading element 38 is minimized and the need for larger memory and data transmission capability is reduced in the system. Information may be transferred from the card reading elements (e.g., 32) from a communication port or wire 44 shown for sensor/reading element 32. Cards may be buffered or staged at various points within the dealing shoe 2, such as where restrained by rollers 26 so that cards partially extend towards the chute 46 past the rollers 28 on plate 43, or staged between rollers 24 and 26, between rollers 17 and 24, between rollers 16 and 17 and the like. Cards may partially overlap in buffering as long as two or more cards are not present between a single set of nip rollers (e.g., 26 and 27) where nip forces may drive both cards forward at the same time.

Other variations are available and within the skill of the artisan. For example, rear panel 12 may have a display panel thereon for displaying information or data, particularly to the dealer (which information would be shielded from players as the rear panel 12 would primarily face the dealer and be shielded from players' view. A more ergonomic and aesthetic rear surface 50 is shown having a display 52 that is capably of providing alphanumerics (letters and numbers) or analog or digital images of shapes and figures in black-and-white or color. For example, the display may give messages as to the state of the shoe, time to number of cards dealt, the number of deals left before a cut card or virtual cut card is reached (e.g., the dealing shoe identifies that two decks are present, makes a virtual cut at 60 cards, and based on data input of the number of players at the table, identifies when the next deal will be the last deal with the cards in the shoe), identify any problems with the shoe (e.g., low power, card jam, where a card is jammed, misalignment of cards by rollers, and failed element such as a sensor), player hands, card rank/suit dispensed, and the like. Also on the rear surface 50 are two lights 54 and 56, which are used to show that the shoe is ready for dealing (e.g., 54 is a green light) or that there is a problem with the dealing capability of the shoe (e.g., 56 is a red light). The memory board 58 for the card-reading sensor 38 is shown with its information outlet 44 shown.

There are significant technical and ergonomic advantages to the present structure. By having the card in-feed area 4 provide the cards in at least a relatively vertical stack (e.g., with less then a 60° slope of the edges of the cards away from horizontal), length of the delivery shoe 2 is reduced to enable the motor driven delivery and reading capability of the shoe in a moderate space. No other card delivery shoes are known to combine vertical card in-feed, horizontal (or approximately horizontal ±40° slope or ±30° slope away from horizontal) card movement from the in-feed area to the delivery area, with mechanized delivery between in-feed and delivery. The motor drive feed from the vertical in-feed also reduces the need for dealers to have to jiggle the card tray to keep cards from jamming, slipping to undesirable angles on the chutes, and otherwise having to manually adjust the in-feed cards, which can lead to card spillage or exposure as well as delaying the game.

Figure 2:
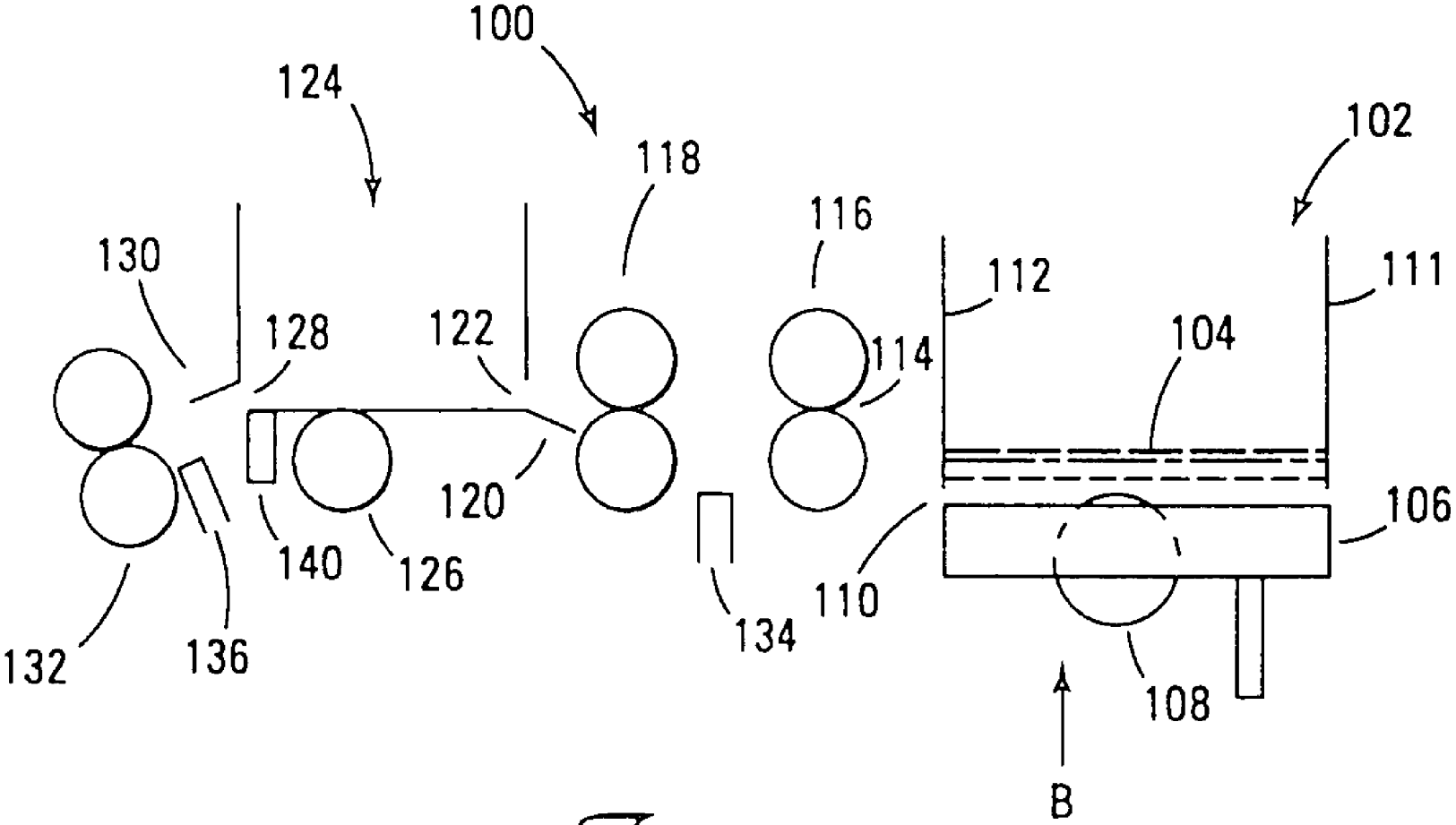
FIG. 2 shows a schematic section of the dealing shoe having the card reading and buffer area.

FIG. 2 shows an alternate embodiment for internal card buffering and card moving elements of the card delivery tray 100. A card in-feed area 102 is provided for cards 104 that sit between walls 111 and 112 on elevator or stationary plate 106 that moves vertically along path B. A pick-off roller 108 drives cards one-at-a-time from the bottom of the stack of cards 104 through opening 110 that is spaced to allow only one card at a time to pass through the hole 110. The individual cards are fed into the nip area 114 of the first speed control or guide rollers 116 and then into the second set of speed control or guide rollers 118. The cards (one-at-a-time) passing through rollers 118 are shown to deflect against plate 120 so that cards flare up as they pass into opening 122 and will overlay any cards (not shown) in card buffer area 124. A second pick-off roller is shown within the buffer area 124 to drive cards one-at-a-time through opening 128. The individual cards are again deflected by a plate 130 to pass into guide rollers 132 that propels the cards into the delivery area (not shown) similar to the delivery area 36 in FIG. 1. Card reading elements may be positioned at any convenient point within the card delivery element 100 shown in FIG. 2, with card reading elements 134 and 136 shown as exemplary convenient locations.

Figure 3:
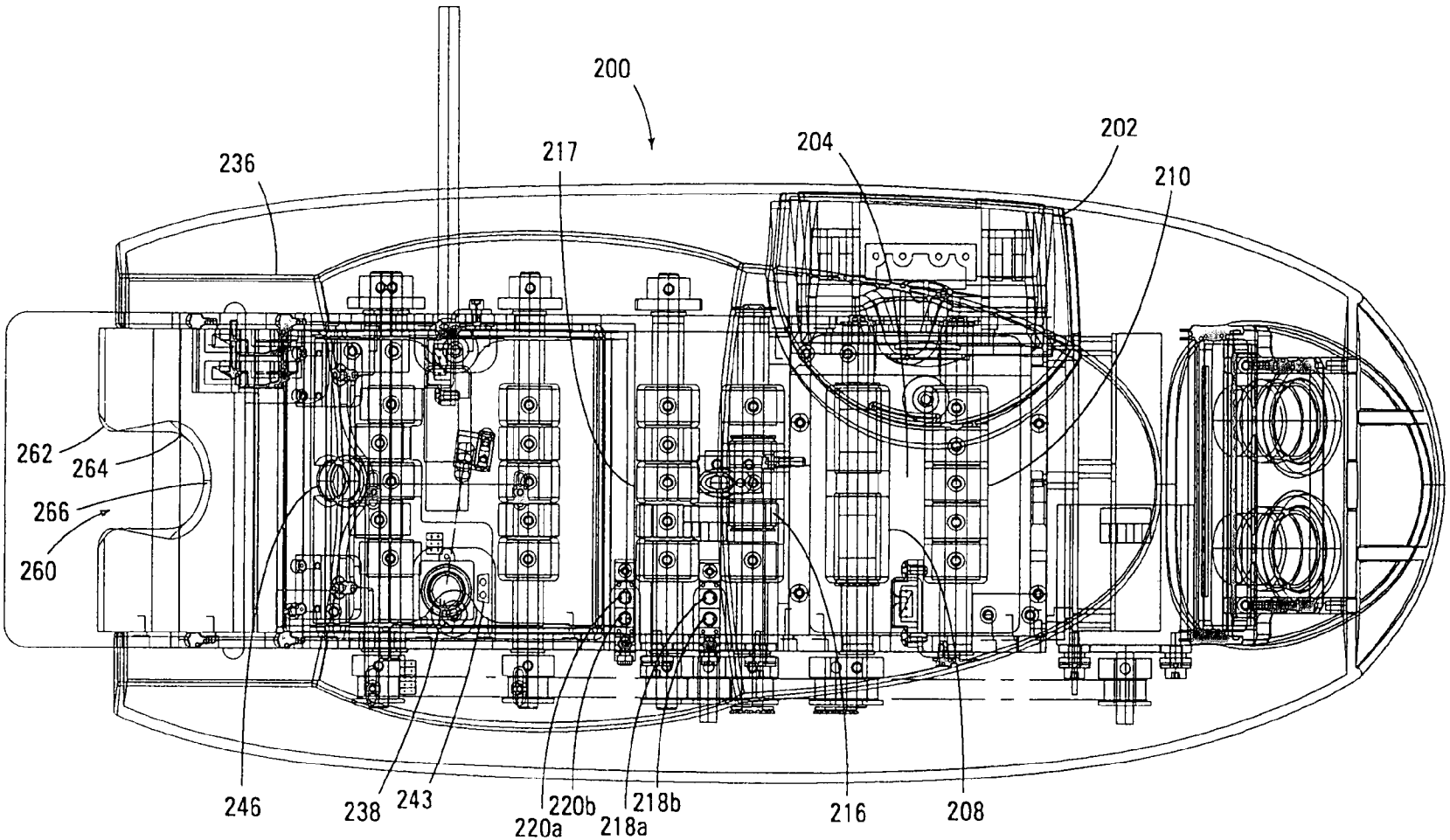
FIG. 3 shows a top cutaway view of one embodiment of a dealing shoe of FIG. 1 according to the present invention.

FIG. 3 shows a top cutaway view of the dealing shoe 200 of an embodiment of the present invention. A flip up door 202 allows cards to be manually inserted into the card input area 204. The sets of pick-off rollers 208 and 210 are shown in the card input area 204. The position of the sensors 218*a* and 218*b* and 220*a* and 220*b* are shown outwardly from the sets of five brake rollers 216 and five speed up rollers 217. The sensors are shown in sets of two sensors, which is an optional construction and single sensors may be used. The dual set of sensors (as in 220*a* and 220*b*) are provided with the outermost sensor 220*b* providing simply sensing card presence ability and the inner innermost sensor 220*a* reads the presence of card to trigger the operation of the camera card reading sensor 238 that reads at least value, and optionally rank, and suit of cards. The sensor 220*a* alternatively may be a single sensor used as a trigger to time the image sensing or card reading performed by camera 238 as well as sensing the presence of a card. An LED light panel 243 or other light providing system is shown present as a clearly optional feature. A sensor 246 at the card removal end 236 of the shoe 200 is provided. The finger slot 260 is shown at the card delivery area 236 of the shoe 200. The lowest portion 262 of the finger slot 260 is narrower then the top portion 264 of the finger slot. The walls 266 may also be sloped inwardly to the shoe and outwardly towards the opening 260 to provide an ergonomic feature to the finger slot 260.

The term camera is intended to have its broadest meaning to include any component that accepts radiation (including visible radiation, infrared, ultraviolet, etc.) and provides a signal based on variations of the radiation received. This can be an analog camera or a digital camera with a decoder or receiver that converts the received radiation into signals that can be analyzed with respect to image content. The signals may reflect either color or black-and-white information or merely measure shifts in color density and pattern. Area detectors, semiconductor converters, optical fiber transmitters to sensors or the like may be used. Any convenient software may be used that can convert to radiation signals to information that can identify the suit/rank of a card from the received signal. The term camera is not intended to be limited in the underlying nature of its function. Lenses may or may not be needed to focus light, mirrors may or may not be needed to direct light and additional radiation emitters (lights, bulbs, etc.) may or may not be needed to assure sufficient radiation intensity for imaging by the camera.

There are a number of independent and/or alternative characteristics of the delivery shoe that are believed to be unique in a device that does not shuffle, sort, order or randomize playing cards.

1) Shuffled cards are inserted into the shoe for dealing and are mechanically moved through the shoe but not mechanically removed from the shoe.

2) The shoe may optionally mechanically feed the cards (one at a time) to a buffer area where one, two or more cards may be stored after removal from a card input area (before or after reading of the cards) and before delivery to a dealer accessible opening from which cards may be manually removed.

3) An intermediate number of cards are positioned in a buffer zone between the input area and the removal area to increase the overall speed of card feeding with rank and/or suit reading and/or scanning to the dealer.

4) Sensors indicate when the dealer accessible card delivery area is empty and cards are automatically fed from the buffer zone (and read then or earlier) one-at-a-time.

5) Cards are fed into the dealer shoe as a vertical stack of face-down cards, mechanically transmitted approximately horizontally, read, and driven into a delivery area where cards can be manually removed.

6) Sensors detect when a card has been moved into a card reading area. Signal sensors can be used to activate the card reading components (e.g., the camera and even associate lights) so that the normal symbols on the card can be accurately read.

With regard to triggering of the camera, a triggering mechanism can be used to set of the camera shot at an appropriate time when the card face is expected to be in the camera focal area. Such triggers can include one or more of the following, such as optical position sensors within an initial card set receiving area, an optical sensor, a nip pressure sensor (not specifically shown, but which could be within either nip roller (e.g., 16 or 17) and the like. When one of these triggers is activated, the camera is instructed to time its shot to the time when the symbol-containing corner of the card is expected to be positioned within the camera focal area. The card may be moving at this time and does not have to be stopped. The underlying function is to have some triggering in the device that will indicate with a sufficient degree of certainty when the symbol portion of a moving or moved card will be with the camera focal area. A light associated with the camera may also be triggered in tandem with the camera so as to extend the life of he light and reduce energy expenditure in the system.

Casinos wish to understand the play and wagering traits of their customers. Some casinos have employees visually observe customer's game play, manually tracking the gaming and wagering habits of the particular customers. The information allows the casinos to select the number of different games that the casino will provide and to adequately staff those games. The information also allows the casinos to select certain customers to receive complimentary benefits ("comps") and to determine the amount of comps a particular customer is to receive. The act of giving comps to a customer produces a large amount of goodwill with the customers, encouraging customer loyalty and further wagering. Some casinos have attempted to partially automate the tracking process, reading a customer "comp" card to identify the customer. The actual gaming and wagering patterns of the customers are visually observed by casino personnel and manually entered into a computer to create a digitized copy of the customer's gaming habits.

Similarly, casinos wish to track the efficiency of the casino and the casino's employees, as well as track betting and winning tendencies of individual players to avoid card counters or other play strategies that casinos consider to be undesirable. Such information allows the casino to make changes to identified situations and to increase the overall efficiency of the casino and of the employees, benefiting both the casino and customers. A typical method of tracking employee efficiency is to manually count the number of hands of blackjack dealt by a dealer over some time period. A change in an amount in a bank at the gaming table can also be manually determined and combined with the count of the number of hands to determine a won/loss percentage for the dealer. The casino can use the information to take appropriate action, such as rewarding an efficient dealer, or providing additional training to an inefficient dealer.

The fast pace and large sums of money make casinos regular targets for fraud, cheating and stealing. Casinos employ a variety of security measures to discourage cheating or stealing by both customers and employees. For example, surveillance cameras covering a gaming area or particular gaming table provide a live or taped video signal that security personnel can closely examine. Additionally, or alternatively, "pit managers" can visually monitor the live play of a game at the gaming table. The ability to track cards, track card play, track cards between a shuffling step (where the order of cards is identified by the shuffler through a reading function) and the dealing step (by reading cards in the dealing shoe) adds a further level of security to the casino and provides a clear basis of data for analysis by a central computer.

While some aspects of a casino's security system should be plainly visible as a deterrent, other aspects of the security should be unobtrusive to avoid detracting from the players' enjoyment of the game and to prevent cheaters and thieves from avoiding detection. The ability of a dealing shoe to read cards outside the view of players is a benefit to the secure environment without increasing the negative effects of players repeatedly seeing security devices.

The delivery shoe, it methods and apparatus may be generally defined as card delivery shoe having a storage end and a delivery end. The shoe stores a first set of cards in the storage end and allows manual removal of cards from the delivery end. There may be at least one first sensor in the delivery end that senses when a card is absent from the delivery end. The sensor provides a signal (to some intelligence or signal receiving function) and a signal or power is provided to a motor so that a card is delivered to the delivery end. A motor mechanically delivers a card to the delivery end of the shoe as a result of the initial sensing of the absence of any card from the delivery end, especially where the card may be manually removed from the delivery end. The card delivery shoe of card may also have at least one sensor reads card values in the card delivery shoe before a card that is read is stationery in the card delivery end.

A desirable set of image capture devices (e.g., a CCD automatic camera) and sensors (e.g., light-emitting devices and light capture devices) will be described, although a wide variety of commercial technologies and commercial components are available. A preferred camera is the "Dragonfly™" automatic camera provided by Point Grey Corporation an includes a 6 pin IEEE-1394 interface, asynchronous trigger, multiple frame rates, 640×480 or 1024×724 24-bit true color or 8-bit gray scale images, image acquisition software and plug-and-play capability. This can be combined with commercially available symbol recognition software. The commercially available image recognition software is trained on card symbols and taught to report image patterns as specific card suits and ranks. Once a standard card suit/rank recognition program has been developed, the training from one format of cards to another becomes more simply effected and can be done at the casino table or by a security team before the smart discard rack is placed on the table. Position sensors can be provided and enhanced by one of ordinary skill in the art from commercially available components that can be fitted by one ordinarily skilled in the art. For example, various optics such as SICK WT2S-N111 or WL2S-E11; OMRON EE SPY302; or OPTEK OP506A may be used. A useful encoder can be purchased as US Digital encoder 24-300-B. An optical response switch can be provided as MicroSwitch SS541A. The triggers can also initiate lights that are used with the camera to enhance available light for image capture.

An alternative way of describe other embodiments of the invention include a description as a playing card delivery shoe from which cards may be dealt comprising a) an area for receiving a first set of cards;

b) first card mover that moves cards from the first set to a card staging area wherein at least one card is staged in an order by which cards are removed from the first set of and moved to the card staging area;

c) second card mover that moves cards from the card staging area to a delivery area wherein cards removed from the staging area to the delivery shoe are moved in the same order by which cards were removed from the first set of cards and moved to the card staging area; and d) card reading sensors that read at least one element of information of card rank, card suit or card value of each card separately after each card has been removed from the area for receiving the first set of cards and before removal from the card delivery area.

The shoe may optionally a maximum capacity of at least one card but less then an entire deck of cards present in the staging area. Preferably from 1 to 2 cards are present in the staging area, most preferably only one card is present. After completion of card reading of at least one card in step d), a system of comparison may be present to compare the suit and rank of the at least one card to expected card information. The expected card information may be present in a memory storage component in the shoe or external computer for each shuffled set of cards inserted in the area for receiving a shuffled set of cards. The memory storage area may also be in a central computer and read information from the shoe is relayed to the central computer for comparison. The system of comparison may be present to compare the suit and rank of the cards read in step d) with the expected card information for each shuffled set of cards inserted in the area for receiving a shuffled set of cards. The at least one information is read by the device before the card is being removed from the storage device. Preferably, the first set of cards comprises a shuffled set of cards.

Certain aspects of the invention may alternatively be described as a card storage shoe comprising a card in-feed area where an approximately vertical set of cards can be seated. The shoe could have a card-moving element that moves one card at-a-time from the approximately vertical set of cards. There could be an automatic mechanical transporting system for horizontally transporting individual ones of cards moved from the vertical set of cards to a card delivery area. There is preferably (but optionally) a card reading system that reads at least one of suit, rank and value of cards before read cards become stationary in the card delivery area. In one embodiment, a buffer area is present between the card in-feed area and the card delivery area and at least some cards remain stationary for a time in the buffer area before being delivered to the card delivery area. Cards may be read, for example, entering or while stationery in the buffer area. It is one embodiment to have only one card present in the card buffer area at any time. It is one aspect of an embodiment of the invention for cards to be read in the shoe after they leave the card buffer area but before they are completely stationary in the card delivery area. They may be read when stationery in the card buffer area, but not in the card delivery area. There may be more than one sensor present along a path between the card in-feed area and the card delivery area to detect the presence of cards at specific locations.

There may be design and function reasons in certain embodiments to have a sensor-reader (e.g., a camera or any other form of image detector) read cards discontinuously when the sensor-reader is triggered by a card detection sensor in the shoe.

A method is available for providing a card to a dealer for manual delivery of the cards by a dealer, the method comprising:

placing a set of cards within a card in-feed area;

mechanically moving cards from the set of cards from the card in-feed area to a card delivery area where at least some cards become stationary;

reading individual cards for at least one of rank, suit or value after the cards are removed from the card in-feed area and before the cards become stationary in the card delivery area.

The method may have the set of cards is placed in an approximately vertical stack in the card feed area. At least one card from the set of cards may be moved to a buffer area between the in-feed area and the card delivery area, and at least one card may remain stationary within the buffer area until the card delivery area is sensed to be empty of cards. The at least one card that remains stationary in a buffer area may remain in the buffer area until a signal generated from the shoe indicates that at least one card is to be moved from the buffer area to the card delivery area. The method may be generated by a sensor in the card delivery area indicating that an additional card is desired in the card delivery area. The signal may be generated by a sensor in the card delivery area indicating that no cards are present in the card delivery area.

The above structures, materials and physical arrangements are exemplary and are not intended to be limiting. Angles and positions in the displayed designs and figures may be varied according to the design and skill of the artisan. Travel paths of the cards need not be precisely horizontal from the card input area to the delivery area of the shoe, but may be slightly angled upwardly, downwardly or varied across the path from the card input area to the card delivery area. The cards may be sensed and/or read within the shoe while they are moving or when they are still at a particular location within the shoe.

What is claimed is:

1. A method of providing at least one card to a dealer for manual delivery of the cards by a dealer comprising:

providing a mechanical dealing shoe comprising a card in-feed area, a card delivery area, a card transport mechanism and a card reader located between the card in-feed area and the card delivery area;

placing a set of cards within a card in-feed area;

mechanically moving cards in an order in which cards are removed from the set of cards from the card in-feed area to a card delivery area where at least one card becomes stationary;

reading individual cards for at least one of rank, suit or value after the cards are removed from the card in-feed area and before the at least one card becomes stationary in the card delivery area; and dispensing cards individually from a card dispensing end of the mechanical dealing shoe.

2. The method of claim 1 wherein the set of cards is placed in an approximately vertical stack in the card feed area.

3. The method of claim 1 wherein at least one card from the set of cards is moved to a buffer area between the in-feed area and the card delivery area, and at least one card remains stationary within the buffer area until the card delivery area is sensed to be empty of cards.

4. The method of claim 1 wherein at least one card that remains stationary in a buffer area remain in the buffer area until a signal generated from the shoe indicates that at least one card is to be moved from the buffer area to the card delivery area,

5. The method of claim 4 wherein the signal is generated by a sensor in the card delivery area indicating that no cards are present in the card delivery area.

6. The method of claim 4 wherein the signal is generated by a sensor in the card delivery area indicating that an additional card is desired in the card delivery area.

7. The shoe of claim 1 wherein a card position sensor is present that triggers operation of the card reading sensors so that discontinuous signals of cards are provided by the card reading sensors.

8. The method of claim 1 wherein a card position sensor triggers reading of individual cards so that discontinuous signals of cards are provided.

* * * * *

UNITED STATES PATENT AND TRADEMARK OFFICE

CERTIFICATE OF CORRECTION

PATENT NO. : 7,717,427 B2
APPLICATION NO. : 11/200280
DATED : May 18, 2010
INVENTOR(S) : Attila Grauzer et al.

It is certified that error appears in the above-identified patent and that said Letters Patent is hereby corrected as shown below:

On the title page:
In ITEM (75) Inventors:
LINE 1 change "Atilla Grauzer," to --Attila Grauzer,--

Signed and Sealed this
Second Day of February, 2016

Michelle K. Lee

Michelle K. Lee
*Director of the United States Patent and Trademark Office*